US010590673B2

(12) United States Patent
Anderson et al.

(10) Patent No.: US 10,590,673 B2
(45) **Date of Patent: *Mar. 17, 2020**

(54) TILT TOWER AND PIPE AUGER ANCHOR ASSEMBLY

(71) Applicant: Paula C. Anderson, San Angelo, TX (US)

(72) Inventors: Charles Anderson, San Angelo, TX (US); Joshua Anderson, San Angelo, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/487,167

(22) Filed: Sep. 16, 2014

(65) Prior Publication Data

US 2015/0020464 A1 Jan. 22, 2015

Related U.S. Application Data

(63) Continuation of application No. 13/870,290, filed on Apr. 25, 2013, now Pat. No. 8,863,450.

(60) Provisional application No. 61/776,231, filed on Mar. 11, 2013.

(51) Int. Cl.
*E04H 12/34* (2006.01)
*E04H 12/22* (2006.01)

(52) U.S. Cl.
CPC ..... *E04H 12/345* (2013.01); *E04H 12/2215* (2013.01)

(58) Field of Classification Search
CPC ..... E04H 12/345; E04H 12/2215
USPC ..... 52/116, 117, 119, 157, 165, 169.13, 296, 52/298
See application file for complete search history.

(56) References Cited

U.S. PATENT DOCUMENTS

| | | | | |
|---|---|---|---|---|
| 1,102,413 | A | 7/1914 | Jensen | |
| 2,065,715 | A | 12/1936 | Leon | |
| 2,489,720 | A | 11/1949 | Newell et al. | |
| 2,548,650 | A | 4/1951 | Brandt | |
| 2,804,950 | A | 9/1957 | Leslie | |
| 2,812,833 | A | 11/1957 | O'Nan | |
| 2,822,066 | A | 2/1958 | Ingvald | |
| 2,875,865 | A | 3/1959 | Rohn | |
| 2,882,080 | A | 4/1959 | Burns | |
| 3,257,765 | A * | 6/1966 | Anderson et al. | 52/298 |
| 3,299,429 | A | 1/1967 | McMullin | |
| 3,318,560 | A | 5/1967 | Garrette, Jr. et al. | |

(Continued)

OTHER PUBLICATIONS

Understanding Weld Symbols—The Fillet Weld, Meyer Tool & Mfg. Inc. Nov. 25, 2015.

*Primary Examiner* — Adriana Figueroa
(74) *Attorney, Agent, or Firm* — Jackson Walker LLP

(57) ABSTRACT

A tilt tower and pipe auger anchor assembly comprising a tilt tower having a mast and a swing tube and a coax cable engaging both the mast and the swing tube, the mast has a near end, the near end has a mast flange plate with fastener holes therethrough. A pipe auger anchor has walls defining a generally hollow elongated body having a near end and a removed end, the near end including a pipe auger anchor flange plate mateable with the mast flange plate. The pipe auger anchor flange plate has fastener openings therein and fixedly attached to the near end perpendicular to the longitudinal axis of the hollow elongated body and an auger at the removed end. The auger provides a penetration force when the body is rotated and the auger is engaged with the ground.

14 Claims, 10 Drawing Sheets

(56) References Cited

U.S. PATENT DOCUMENTS 3,525,225 A 8/1970 Yager et al.
3,656,170 A 4/1972 Smith
3,671,738 A 6/1972 Beachley
3,792,680 A 2/1974 Allen
3,827,197 A 8/1974 Adam
3,875,573 A 4/1975 Bueckert
3,941,083 A 3/1976 Morse et al.
3,942,296 A * 3/1976 Meyer ..... 52/296
3,988,870 A * 11/1976 Snavely ..... 52/296
4,149,347 A 4/1979 Boemer
4,167,740 A 9/1979 Shriver
4,606,155 A 8/1986 Bukovitz et al.
4,697,779 A 10/1987 Guislain
4,979,341 A 12/1990 Norman
5,058,336 A 10/1991 Jenvey
5,448,464 A 9/1995 Moss
5,481,846 A * 1/1996 Macchietto ..... 52/831
5,572,836 A 11/1996 Parker
5,613,329 A 3/1997 Land et al.
5,660,504 A 8/1997 Reinert
5,782,042 A * 7/1998 Klein ..... 52/116
5,944,452 A 8/1999 Reinert
6,327,833 B1 * 12/2001 Miskelley et al. ..... 52/848
6,647,920 B2 11/2003 Lovett
6,712,330 B1 * 3/2004 Damiano ..... 248/519
6,809,702 B2 10/2004 Safakhah
6,820,389 B1 * 11/2004 Macchietto ..... 52/835
7,004,683 B1 2/2006 Rupiper
7,015,872 B1 3/2006 Little
7,025,311 B1 * 4/2006 Gretz ..... 248/156
7,059,096 B2 * 6/2006 Kuebler et al. ..... 52/838
7,172,163 B1 * 2/2007 Johnson ..... 248/146
7,192,252 B2 3/2007 Duguet et al.
7,377,723 B2 5/2008 Nolan
7,432,875 B1 10/2008 Sergi
7,694,487 B1 * 4/2010 Ryan ..... 52/741.15
7,765,770 B2 * 8/2010 Fournier ..... 52/843
7,954,289 B2 * 6/2011 Evans ..... 52/298
8,074,955 B2 * 12/2011 Kumar et al. ..... 248/519
8,130,168 B1 3/2012 Sergi et al.
8,637,767 B2 * 1/2014 Diaz-Vallellanes ..... 174/45 R
8,742,254 B2 * 6/2014 Gordin et al. ..... 174/6
8,875,451 B1 * 11/2014 Parduhn et al. ..... 52/165
2002/0089466 A1 7/2002 Magee et al.
2002/0149536 A1 10/2002 Safakhah
2003/0115826 A1 * 6/2003 Bobbitt ..... 52/726.4
2004/0221543 A1 * 11/2004 Eleas et al. ..... 52/736.1
2007/0175134 A1 8/2007 Christenson
2009/0266016 A1 * 10/2009 Kraft ..... 52/296
2011/0099923 A1 5/2011 Ventura et al.
2011/0283640 A1 11/2011 Miller
2013/0108374 A1 * 5/2013 Okobi ..... 405/259.1

* cited by examiner 16A
24
22

46
26
42
48

42
46
48

PLAN VIEW
SIGNAL BUNGALOW
(OR NEMA BOX)
TRENCH

14
HOLE
14
CONDUIT
FOR COAX
42
COAX
30
32
ELEVATION VIEW
COAX ASSEMBLY - 13
GROUND LINE
HOLLOW
26A
13
CONDUIT FOR
COAX TO
BUNGALOW
26
42
26A
COAX PORT
(SQUARE OR
RECTANGLE)
38

26B
28
10'-0"
TUBE

PLAN VIEW

ELEVATION VIEW

ELEVATION VIEW
TOP OF 10' HELICAL ANCHOR

TILT TOWER AND PIPE AUGER ANCHOR ASSEMBLY

This continuation application claims the benefit of, priority to and incorporates herein by reference, U.S. patent application Ser. No. 13/870,290, filed Apr. 25, 2013, and U.S. Provisional Patent Application Ser. No. 61/776,231, filed Mar. 11, 2013.

FIELD OF THE INVENTION

Tilt towers and methods of affixing tilt towers to a support device partly embedded in the earth.

BACKGROUND OF THE INVENTION

Tilt towers are typically provided for use with antennas, for example, in positive train control (PCT) towers. These tilt towers typically include a foundation engaging a mast and swing tube, the mast and swing tube connected by an axle. One such tilt tower may be found in U.S. patent application Ser. No. 13/473,848, filed May 17, 2012, published Nov. 22, 2012, which application is incorporated by reference herein. One end of the swing tube is normally attached near to the mast the ground and the second end of the swing tube extends well past the removed end of the mast and has an antenna assembly on the removed end thereof. When servicing of the antenna is required, the near end of the swing tube may be released where it fastens to the mast close to the ground and, with a rope on the antenna end of the swing tube, it can be rotated down to ground level for servicing.

Typically masts have a flange which engages four bolts set into a ground embedded precast concrete mass. At an assembly site, a backhoe is used to dig out the soil and the precast concrete foundation is placed in the excavated area. The precast foundation may include an access channel for receiving the coax assembly from the bottom of the mast. A trench may be dug out adjacent the precast mass and the coax assembly, entrained through the precast, may be laid in the trench, typically in conduit, to an equipment or signal bungalow nearby. The coax assembly is engaged to equipment in the signal bungalow in ways known in the art.

SUMMARY OF THE INVENTION

A tilt tower and pipe auger anchor assembly comprising a tilt tower having a mast and a swing tube and a coax cable engaging both the mast and the swing tube, the mast has a near end, the near end has a mast flange plate with fastener holes therethrough. A pipe auger anchor has walls defining a generally hollow elongated body having a near end and a removed end, the near end including a pipe auger anchor flange plate mateable with the mast flange plate. The pipe auger anchor flange plate has fastener openings therein and fixedly attached to the near end perpendicular to the longitudinal axis of the hollow elongated body and an auger at the removed end. The auger provides a penetration force when the body is rotated and the auger is engaged with the ground.

DETAILED DESCRIPTION OF THE PREFERRED EMBODIMENT

Figure 1:
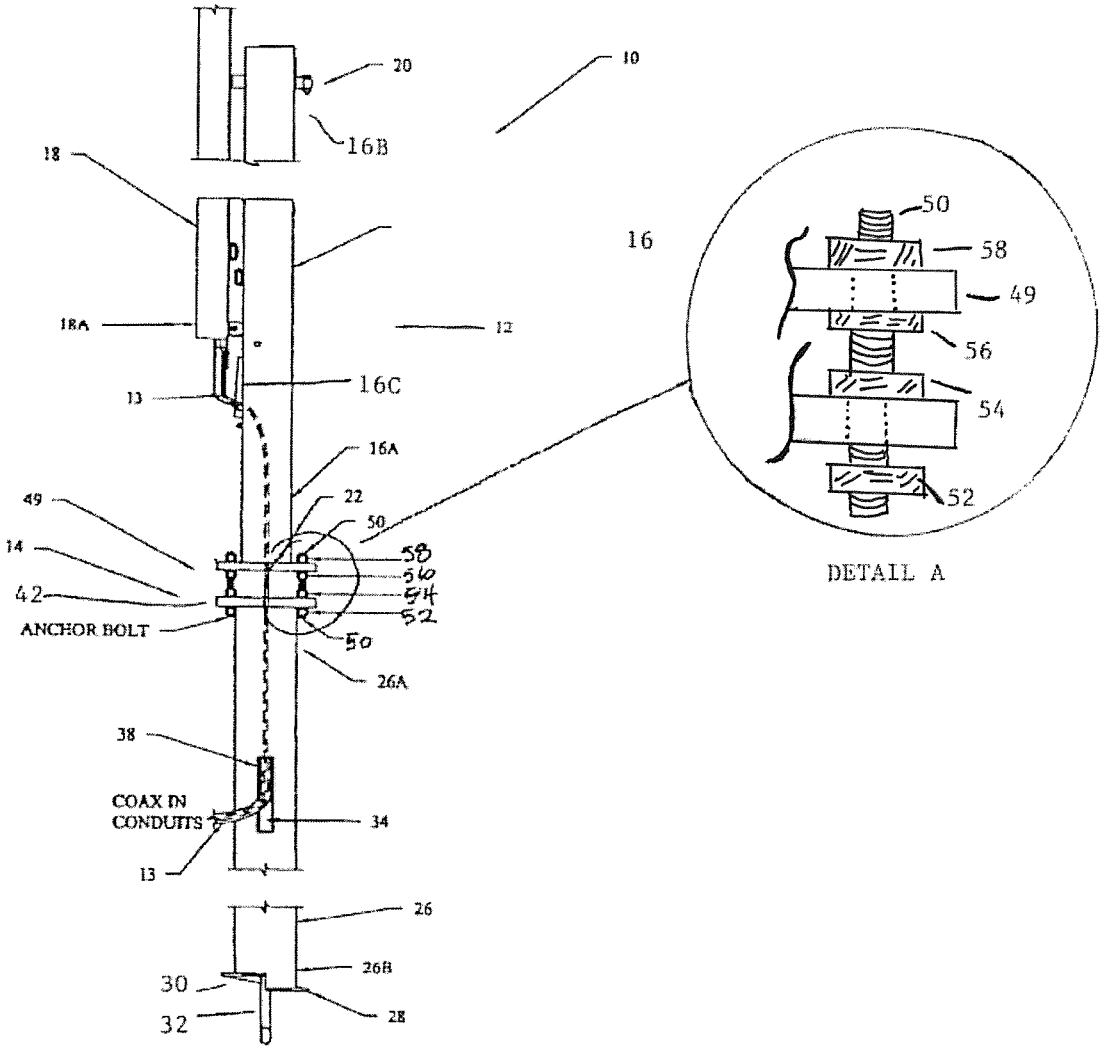
FIG. 1 is a side elevational view of the bottom end of the tilt tower in a manner in which engages the pipe auger anchor assembly to use of engagement members, here, a multiplicity of nut and bolt assemblies, including a cross-section at Detail A.

Applicants disclose a tilt tower and pipe auger assembly 10. The tilt tower and pipe auger assembly 10 includes a tilt tower 12 as known in the art. A coax assembly 13 is engaged with the tilt tower and partly entrained within a mast tube 16, typically entering at a near end 16*a* thereof and exiting at a port 16*c* thereof. Removed end 16*b* of mast 16 includes an axle 20 for engagement of a swing tube 18 as known in the art. Swing tube 18*a* has a near end 18*a* from which coax assembly, when the swing tube is in a normal or use position, may extend thereinto and enter the low end of the mast tube as best seen in FIG. 1.

Figures 2, 3, 4, 5, 6:
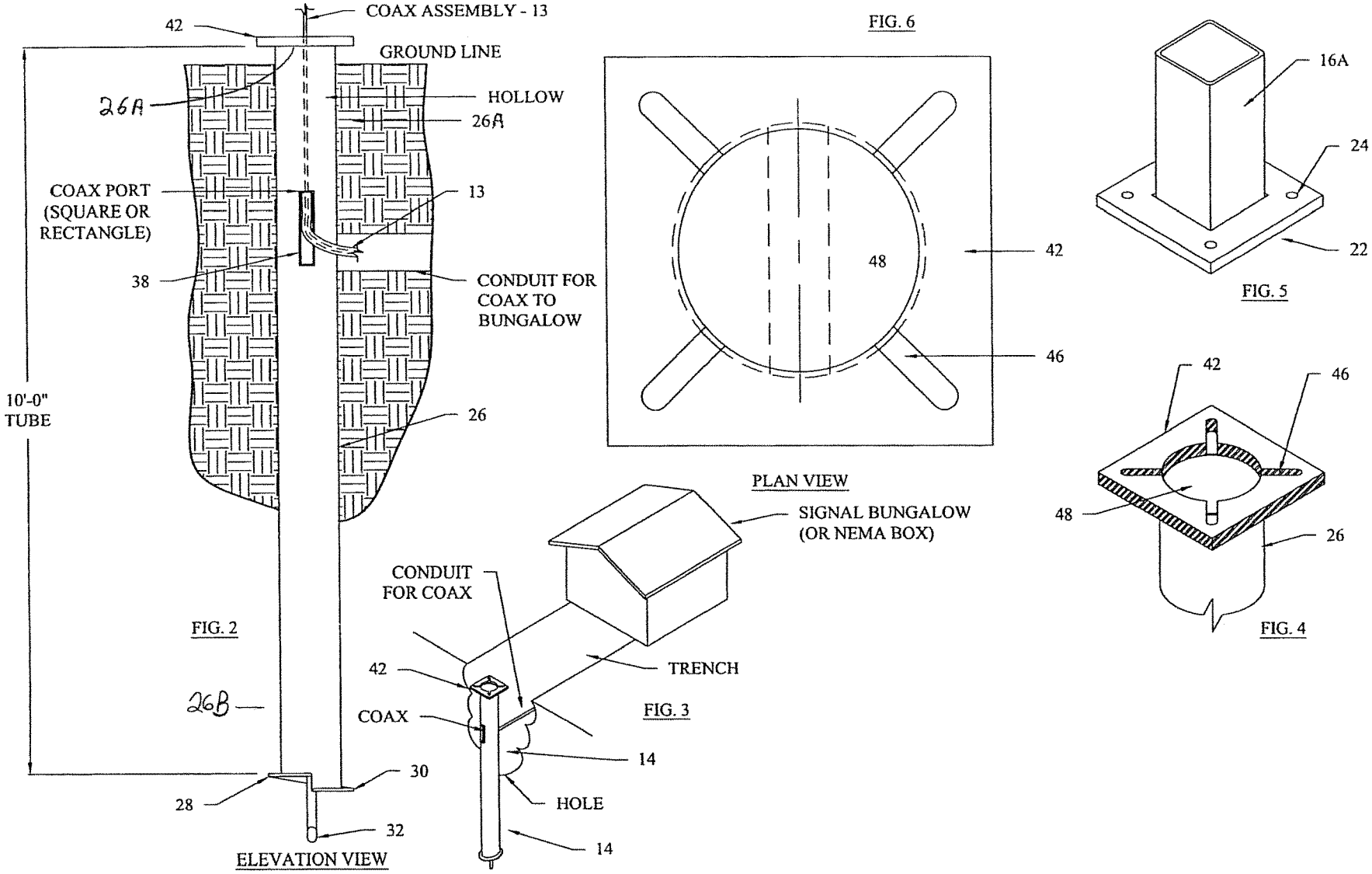
FIG. 2 is a side elevational view of the pipe auger anchor embedded in the ground with just the mating flange plate 42 extending slightly above the ground, FIG. 2 showing the reinforced coax port in the body of the pipe auger anchor.
FIG. 3 is a perspective view cutaway of the pipe auger anchor embedded in the ground in the manner in which the access port allows the coax assembly to join a pipe laying in a trench and carrying the coax assembly to a signal bungalow.
FIG. 4 is a perspective view of the near end of the pipe auger anchor.
FIG. 5 is a perspective view of the near end of the mast of the tilt tower assembly.
FIG. 6 is a top elevational view of the mating flange plate of the pipe auger anchor.

It is seen that mast 16 is typically longitudinal and may have a flange plate 22 rigidly attached as, for example, by weldment (see FIGS. 9A and 9B) to the near end 16*a* and generally perpendicular thereto. Fastener holes 24 are typically provided in the flange portion of flange plate 22 and there may be, for example, four holes as illustrated in FIG. 5.

Pipe auger anchor 14 is seen, in one embodiment, to include an auger body 26 of a near end 26*a* and a removed end 26*b*. At the removed end 26*b* of auger body 26 is an auger 28. Auger 28 may be configured in a number of different ways and may include a helical member 30 and a longitudinal member 32. Auger 28 is configured such that, upon placement against the earth, typically soil, with the longitudinal axis of the auger body 26 generally perpendicular thereto, rotation thereof will provide a penetration force to the pipe auger anchor and it may penetrate the earth. Equipment, known in the art, will provide power to rotate augers into the earth. Rotation of pipe auger anchor into the earth is provided and a hole may be partially (a starter hole) or completely excavated as seen in FIG. 3. Auger body 26 includes at least one coax port, here two shown 34/36. Auger body 26 is typically elongated, round, and hollow with typically cylindrical walls. Coax ports 34/36 are typically about two or three feet down the auger body from near end 26*a*. Auger anchor 14 is between the near end and removed end, about ten feet long, about 10 inches in diameter and has a wall thickness of about ¼ inch. Coax ports 34/36 typically include plate steel welded up reinforcement members 38/40, which may be round, rectangular or other suitable shape and may at least partially extend into the interior (FIGS. 6 and 6A), in one embodiment, and may, in another embodiment, at least partially extend past the exterior walls of auger body 26 as best seen in FIGS. 7 and 8. It is seen that the cutouts of the walls of the auger body 26 to generate coax port 34/36 has a certain area. The area of the walls defining the port reinforcement members 38/40 should be, in one embodiment, an area at least equal to the area defining the coax ports around which the reinforcements are attached, for example, by weldment.

For example, if the coax port is approximately 2.5 inches by 12 inches (about 30 sq. in.), then a total of about thirty square inches of port reinforcement member, typically plate steel, will be used to weld up the weld members around the port. Moreover, if the thickness of auger body is about ¼ inch, the wall members defining the port reinforcement members will be typically at least about ¼ inch thick.

By providing port reinforcement members, including welded up plate steel about the coax port, a weakness in auger body 26 will be substantially alleviated. For example, auger body 26 may vibrate when a mast, stimulated by winds or other forces, begins to vibrate at a harmonic frequency defined by the geometry and materials of the tilt tower assembly. Such harmonic vibrations can be destructive and may cause failure at non-reinforced coax ports. Port reinforcement members, such as those illustrated or other suitable members, are helpful in providing reinforcement about the coax ports and avoiding destructive failure.

It may be seen that near end 26*a* has a mating flange plate 42 attached by weldment 44 or other suitable means. Moreover, it is seen that mating flange plate 42 is perpendicular to the longitudinal axis of auger body 26 and may be dimensioned similarly to flange plate 22 of mast tube 16. Mating flange plate 42 may include a hold-down bolt access area, which may be multiple slots 46 as seen, for example, in FIGS. 4 and 6. Mating flange plate 42 has a coax entry cutout 48. An engagement assembly 49 is provided to rigidly and in a level manner fasten the mast tube to pipe auger anchor 14, typically after pipe auger anchor 14 has been inserted into the ground and the excavation and trench has been backfilled and tamped. Engagement assembly 49 may include a multiplicity of anchor bolts 50.

As seen in the detail portion of FIG. 1, engagement anchor assembly 49 may include an anchor bolt upon which is entrained a number of nuts and washers, the effect of which is to maintain a fixed spatial arrangement between plates 22/42, so as to maintain substantially perpendicular alignment of tilt tower mast tube 16. The nut and washer assemblies include compression lock nut and lock washer 58, leveling nut and flat washer 56, compression nut and lock washer 54, and backup nut and lock washer 52 (which may be a bolt head). These assemblies are typically at all four corners of the opposed plates 22/42.

Turning to FIG. 1, it is seen that anchor bolt 50 (there are typically four) each entrain through fastener hole 24 and hold-down bolt access area 46. A backup nut and lock washer assembly 52 may be provided on the underside of mating flange plate 42. Holding assembly 52 in place may be a compression nut/lock washer assembly 54 engaging the top surface of mating flange plate 42. Anchor bolt 50 extends up through flange plate 22 and includes a leveling nut and flat washer assembly 46 on the underside of flange plate 22 and, on the top side of flange plate 22, is a compression nut/lock washer assembly 58. Leveling of the mast tube may be achieved by adjusting nut position.

Figure 6A:
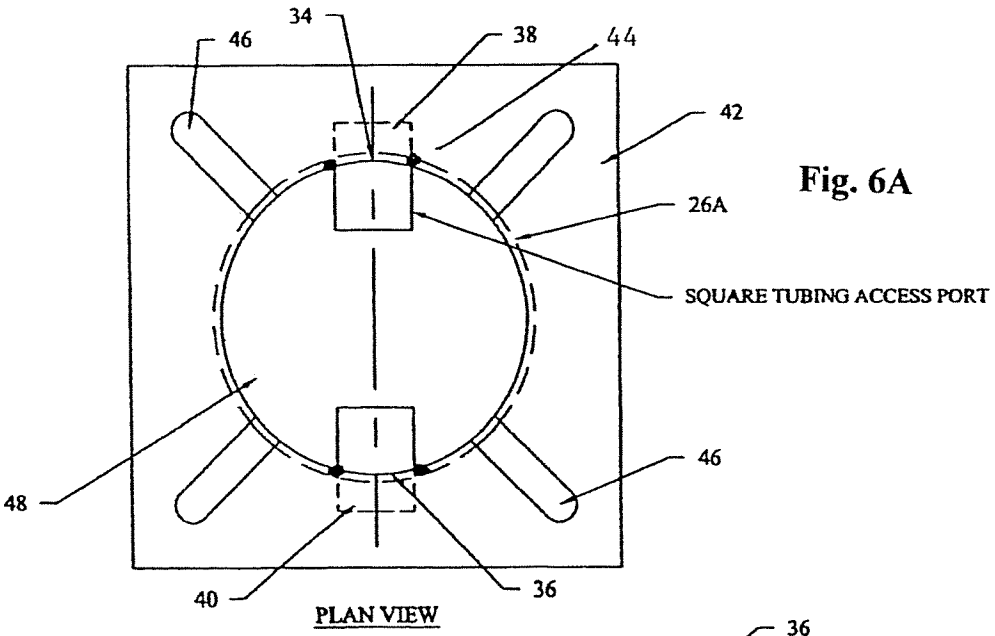
FIG. 6A is a top elevational view of showing the reinforcement members welded flush with the outside surface of the auger body and extending into the auger body.
Figure 7:
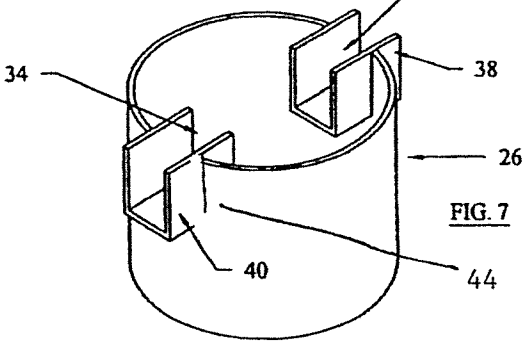
FIG. 7 is a perspective view cutaway across the longitudinal axis of the body of the pipe auger anchor showing the reinforcement members welded about the coax port (two illustrated).
Figure 8:
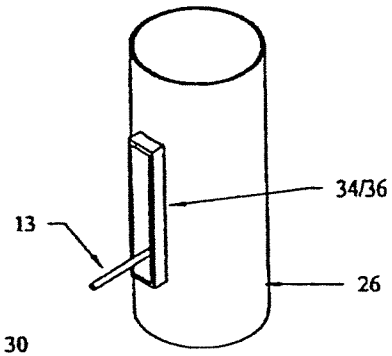
FIG. 8 is a perspective exterior view of the auger body showing the reinforced auger port with coaxial assembly extending therefrom.
Figure 9:
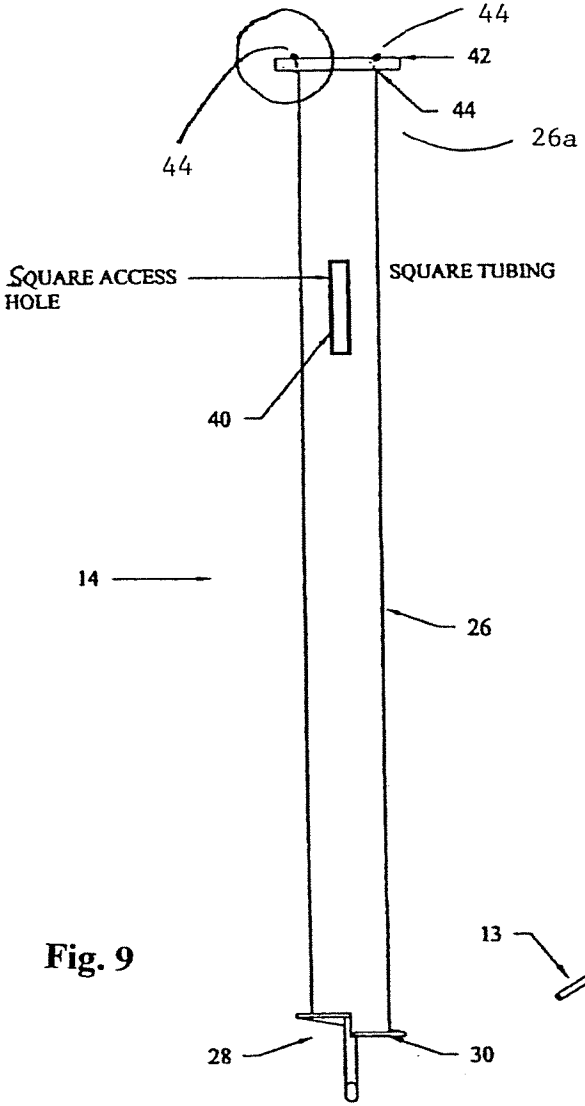
FIG. 9 is an elevational view of a pipe auger anchor, with FIGS. 9A and 9B being detailed views showing preferred weldments at the mating flange/auger body junction.

FIGS. 6A, 7, 8, 9, and 10A-10E illustrate various views of the axis port and reinforcement plates welded thereto. FIG. 6A shows that the plates may extend into the inner body only and be welded where they just touch the outer cylindrical surface of the auger body. FIG. 7 shows that the plates may extend both partially into the interior and into the exterior and weldment typically is placed at the junction of the plates and the exterior of the pipe. FIG. 8 shows that weldment may extend only to the exterior of the pipe and may, in one embodiment, be square or rectangular. FIG. 9 is an elevational view of FIG. 8.

Figure 9A:
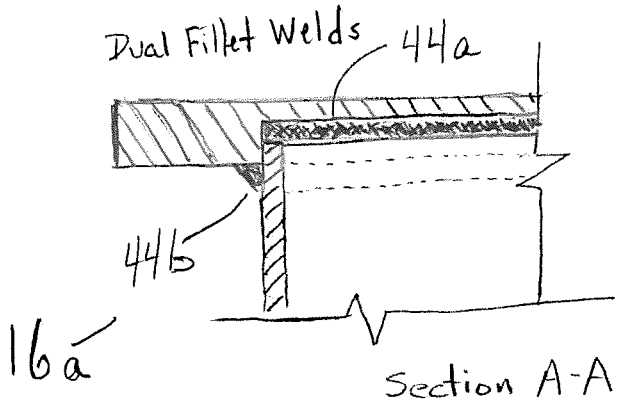
Figure 9B:
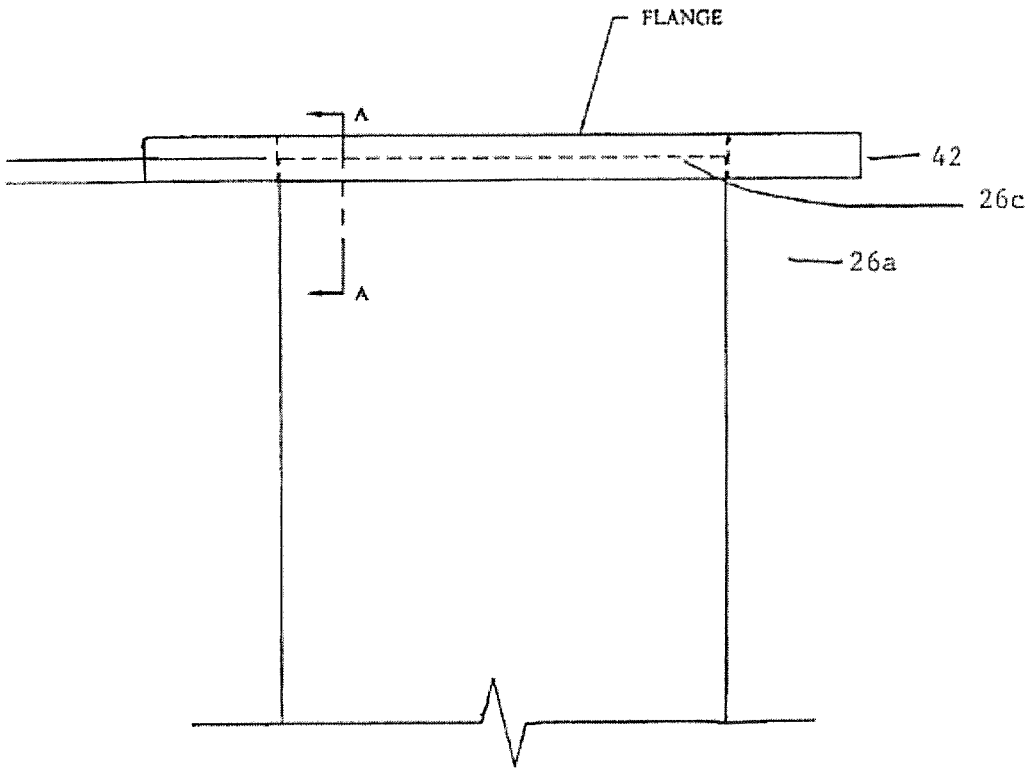

FIGS. 9, 9A, and 9B illustrate details of weldment where mating flange plate 42 joins near end 26*a* of auger body 26. FIG. 9B shows that upper lip 26*c* will be inserted about half the distance of the thickness of mating flange plate 42. FIG. 9A shows that, in a preferred embodiment, dual full pin welds will be applied, typically about ½ inch on the outside and 5/16 inch on the inside, to help prevent overheating of the thin walled pipe. By inserting the upper perimeter 26*c* only halfway or half the distance of the thickness of the plate, sufficient room is provided such that inner weld 44*a* will not project above the top surface of mating plate 42. Outer weld at the junction of lower surface of the mating plate and the outer surface of the near end of the auger body is designated 44*b*. The mating flange 42 should be the same size and thickness as the tower plate of the tower flange plate 22 used. The manufacturer and the engineering staff of the mast can be consulted on such dimensions.

Figure 8A:
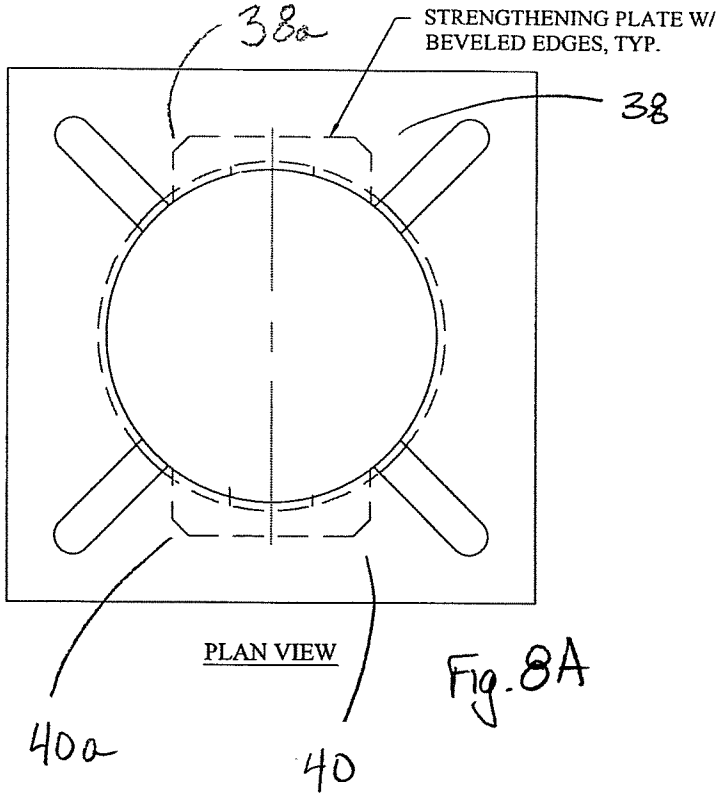
FIGS. 8A and 8B illustrate steel reinforcement members arrangements about the coaxial ports in the auger body.
Figure 8B:
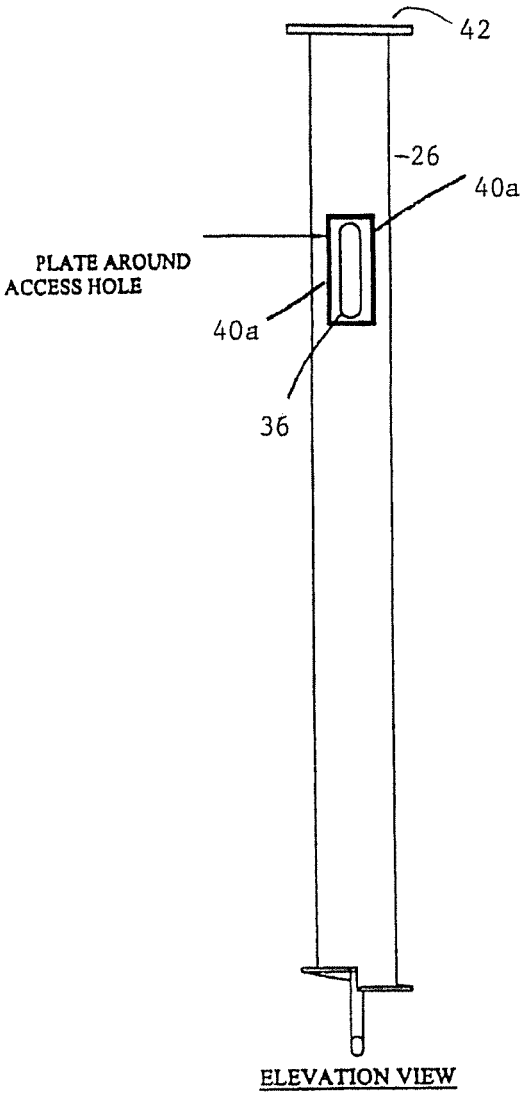

FIGS. 8A and 8B illustrate rectangular exterior strengthening plates, which have beveled corners 38*a*/40*a* on at least some of the corners or edges exposed on the exterior of the body. FIG. 8B illustrates that the shape of the port cutout may be different (here, an elongated oval) than the plating (rectangular at least partly exterior plating).

Figure 10A:
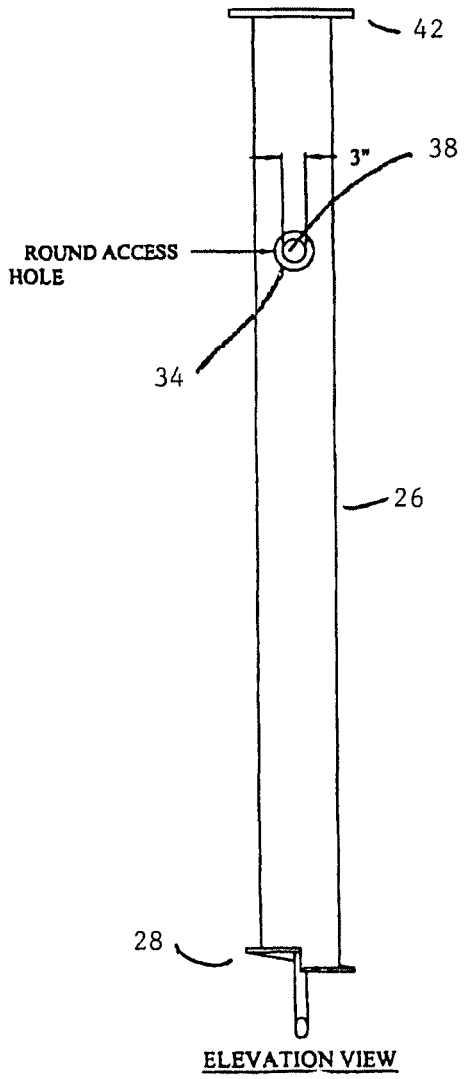
FIG. 10A is an elevational view of a round access hole covered with a circular reinforcement cover plate.
Figure 10B:
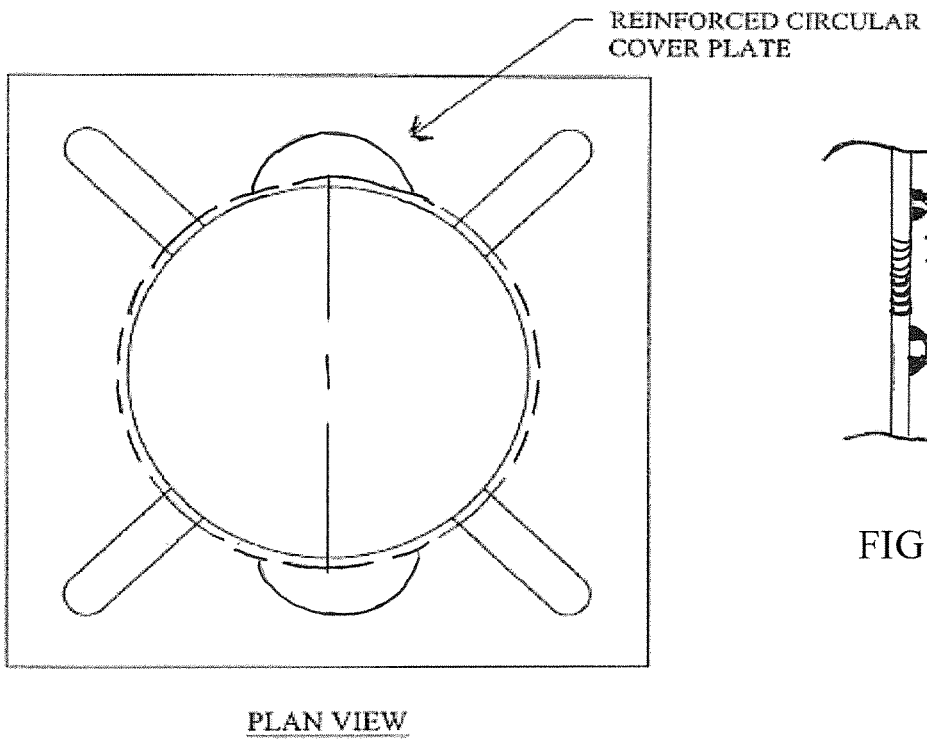
FIGS. 10B and 10C are plan and side cutaway views of the embodiment of FIG. 10A, wherein the reinforcement plate is perpendicular to the body.
Figure 10C:
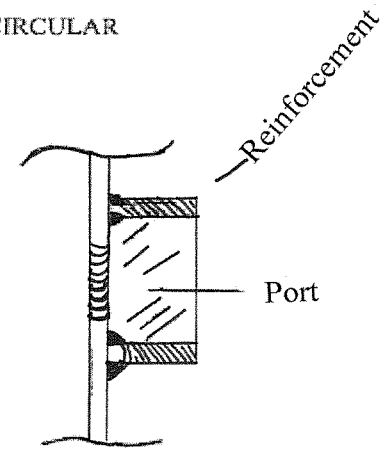
Figures 10D, 10E:
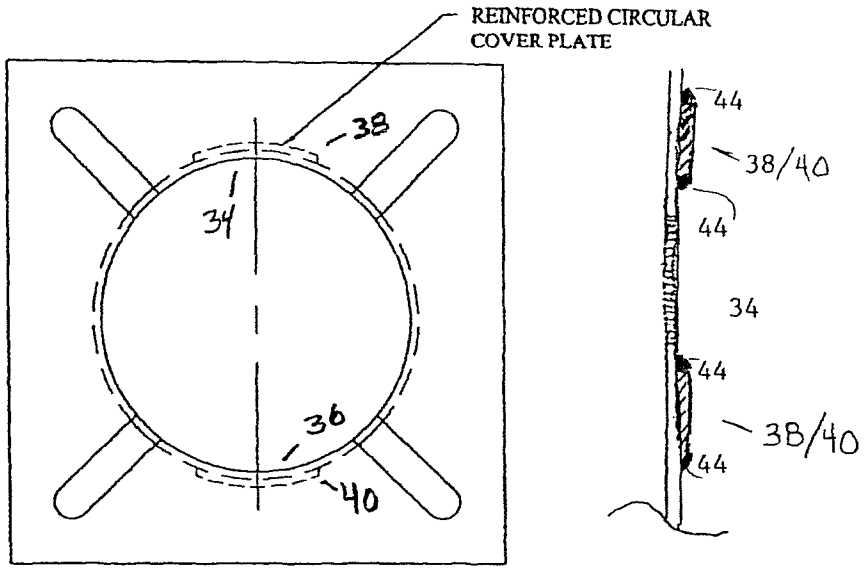
FIGS. 10D and 10E are plan and side cutaway views of the embodiment of FIG. 10A, wherein the reinforcement plate is flush to the body of the auger.

FIGS. 10A, 10B, and 10C illustrate that a circular configuration may be provided for port reinforcement members 38/40. That is to say, in this embodiment, the plate steel may be cylindrical conduit or configured flat plate (earlier embodiments), which may extend outward of the body, partially inside the body or fully inside or fully outside (as seen in FIGS. 10B and 10C) the body of the auger. In this embodiment, the cylindrical reinforcement member typically may be shaped with an inner perimeter that will contact the surface of the auger body. In one embodiment, the outline of the reinforcement members will reflect that of the port, rectangular port, rectangular reinforcement members, round port, cylindrical round reinforcement members (FIGS. 100 and 10D). In other embodiments, they are mixed.

FIGS. 10D and 10E show an embodiment where the reinforcement members 38/40 are placed flat against the cylindrical external body and welded 44 thereto. In earlier embodiments, whether round or rectangular plates, they are placed perpendicular to the hole, for example, see FIGS. 7 and 10C, compare FIG. 10F, flat laying plates. In other words, embodiments of the plates may put the face of the plates flush against the curved surface or the major faces of the plates are perpendicular thereto.

In summary, regarding reinforcements of the port, it is seen that the reinforcement members may be plate or cylindrical or other suitable steel, and may be fully inside the body, fully outside the body or partially inside or outside. Moreover, square, rectangular or cylindrical steel may be used or any other suitable shape.

Although the invention has been described with reference to a specific embodiment, this description is not meant to be construed in a limiting sense. On the contrary, various modifications of the disclosed embodiments will become apparent to those skilled in the art upon reference to the description of the invention. It is therefore contemplated that the appended claims will cover such modifications, alternatives, and equivalents that fall within the true spirit and scope of the invention.

The invention claimed is:

1. An earth penetrating anchor assembly for anchoring a mast having a near end with a mounting plate having fastener holes, the earth penetrating anchor comprising:

a hollow elongated cylindrical body having an outer surface, a near end with an upper perimeter, a removed end with a helical member attached to the removed end, and a middle portion between the near and removed ends; and a flange plate having a top surface, a bottom surface, a thickness and walls defining a cutout for receiving the near end of the hollow elongated cylindrical body, the flange plate having fastener holes;

wherein the flange plate engages the near end of the hollow elongated cylindrical body, such that the upper perimeter of the hollow elongated cylindrical body is adjacent the walls defining the cutout, below the top surface of the flange plate and above the bottom surface of the flange plate;

further comprising a coupling between the flange plate and the hollow elongated cylindrical body comprising a first full fillet weld and a second full fillet weld;

wherein the first full fillet weld contacts and secures the upper perimeter to the walls defining the cutout, the first full fillet weld located below the top surface of the flange plate, the first full fillet weld sized, when measured on its leg, so that it is smaller than the second full fillet weld; and wherein the second full fillet weld contacts and secures the outer surface of the hollow elongated cylindrical body to the bottom surface of the flange plate, the second full fillet weld sized, when measured on its leg, so that it is larger than the hollow elongated cylindrical body's wall thickness.

2. The earth penetrating anchor assembly of claim 1, wherein the hollow elongated cylindrical body has a cable access port.

3. The earth penetrating anchor assembly of claim 2, wherein the cable access port has reinforcement members.

4. The earth penetrating anchor assembly of claim 3, wherein the cable access port reinforcement members have an area at least equal to the area of the cable access port.

5. The earth penetrating anchor assembly of claim 2, wherein the cable access port is more than four times as long as it is wide.

6. The earth penetrating anchor assembly of claim 1, wherein the second weld is at least fifty percent larger than the wall thickness of the hollow cylindrical body.

7. The earth penetrating anchor assembly of claim 1, wherein the second weld is at least fifty percent larger than the first weld.

8. The earth penetrating anchor assembly of claim 1, wherein the first weld is not flush with the top surface of the flange plate.

9. The earth penetrating anchor assembly of claim 8, wherein the first weld terminates more than fifty percent of its size, when measured on its leg, from the top surface of the flange plate.

10. The earth penetrating anchor of claim 1, wherein the coupling between the flange plate and the hollow elongated cylindrical body consists essentially of the first fillet weld and the second fillet weld.

11. The earth penetrating anchor of claim 1, wherein the removed end of the hollow elongated cylindrical body is closed.

12. A tower comprising: a mast having a near end with a mounting plate having fastener holes and a mounting plate; and an earth anchor comprising:

a hollow elongated cylindrical body having an outer surface, a near end with an upper perimeter, a removed end with a helical member attached to the removed end, and a middle portion between the near and removed ends; and a flange plate having a top surface, a bottom surface, a thickness and walls defining a cutout for receiving the near end of the hollow elongated cylindrical body, the flange plate having fastener holes;

wherein the flange plate engages the near end of the hollow elongated cylindrical body, such that the upper perimeter of the hollow elongated cylindrical body is adjacent the walls defining the cutout, is below the top surface of the flange plate and above the bottom surface of the flange plate; and further comprising a weld attachment of the flange plate to the hollow elongated cylindrical body comprising a first full fillet weld and a second full fillet weld;

wherein the first full fillet weld contacts and secures the upper perimeter to the walls defining the cutout, the first full fillet weld located below the top surface of the flange plate, the first full fillet weld sized, when measured on its leg, so that it is smaller than the second full fillet weld; and wherein the second full fillet weld contacts and secures the outer surface of the hollow elongated cylindrical body to the bottom surface of the flange plate, the second full fillet weld sized, when measured on its leg, so that it is larger than the hollow elongated cylindrical body's wall thickness.

13. The earth penetrating anchor assembly of claim 1, wherein the upper perimeter of the hollow elongated cylindrical body is inserted into the flange plate no more than half way between the top surface of the flange plate and the bottom surface of the flange plate.

14. The tower of claim 12, wherein the upper perimeter of the hollow elongated cylindrical body is inserted into the flange plate no more than half way between the top surface of the flange plate and the bottom surface of the flange plate.

* * * * *